US011565922B2

(12) United States Patent
Iotti

(10) Patent No.: US 11,565,922 B2
(45) Date of Patent: Jan. 31, 2023

(54) REMOTE CONTROLLED TELEHANDLER

(71) Applicant: MANITOU ITALIA S.R.L., Castelfranco Emilia (IT)

(72) Inventor: Marco Iotti, Reggio Emilia (IT)

(73) Assignee: MANITOU ITALIA S.R.L., Castelfranco Emilia (IT)

( * ) Notice: Subject to any disclaimer, the term of this patent is extended or adjusted under 35 U.S.C. 154(b) by 267 days.

(21) Appl. No.: 16/353,742

(22) Filed: Mar. 14, 2019

(65) Prior Publication Data

US 2019/0300349 A1 Oct. 3, 2019

(30) Foreign Application Priority Data

Mar. 30, 2018 (IT) ..... 102018000004152

(51) Int. Cl.
*B66F 9/075* (2006.01)
*B66F 9/065* (2006.01)
*B66F 11/04* (2006.01)

(52) U.S. Cl.
CPC ..... *B66F 9/07581* (2013.01); *B66F 9/0655* (2013.01); *B66F 9/07559* (2013.01); *B66F 11/046* (2013.01)

(58) Field of Classification Search
None
See application file for complete search history.

(56) References Cited

U.S. PATENT DOCUMENTS 3,059,795 A * 10/1962 Schroeder ..... B66F 9/07545 414/633
5,584,646 A * 12/1996 Lewis ..... B66C 1/68 180/211
7,671,547 B2 * 3/2010 Addleman ..... B66C 23/66 318/14
9,834,423 B2 * 12/2017 Magni ..... B66C 23/80
9,908,763 B2 3/2018 Bagge
2011/0264306 A1 * 10/2011 Bagge ..... B66F 9/182 701/2
2013/0004265 A1 1/2013 Bagge
2017/0001846 A1 1/2017 Paavolainen

FOREIGN PATENT DOCUMENTS

EP 1340708 A1 9/2003
EP 2080730 A1 * 7/2009 ..... E02F 9/121
EP 3112312 A1 1/2017
WO 2011048441 A1 4/2011

* cited by examiner

*Primary Examiner* — Michael S Lowe
(74) *Attorney, Agent, or Firm* — Pearne & Gordon LLP; John P. Murtaugh

(57) ABSTRACT

The movable lifting system (1, 2) comprising a telehandler (1) which in turn comprises: a movable lifting arm (11) provided at a distal end, with a coupling device (111) for the removable fixing of equipment (112) or of the type adapted to grip loads, such as a fork, grippers or the like, or of the type suitable for lifting persons and work tools such as a basket or the like; and a powertrain assembly for movement on the ground.

The system (1, 2) further comprises: control means, arranged on board the telehandler (1), provided to manage the operation of the powertrain assembly, adapted to receive command signals and adapted to regulate the operation of the assembly according to the command signals; and command means (2), separate from the telehandler (1), to be activated by an operator (3) and predisposed to produce the command signals.

11 Claims, 2 Drawing Sheets

REMOTE CONTROLLED TELEHANDLER

The present invention relates to a remote-controlled self-propelled telehandler, especially but not exclusively intended for hire.

Known telescopic handlers or "telehandlers" comprise a vehicle equipped with a movable frame on tracks or wheels and comprising a driving cab and a telescopically extendable lifting arm.

The distal end of the arm has a coupling device for the removable fixing of equipment adapted to grip loads, for example a fork, a gripper or the like, or a basket for lifting persons and work tools.

There are two alternatives for bringing the telehandler to a work site, for example a construction site: either the vehicle is driven on the road by the operator or it is transported through another means, for example on the trailer of a lorry.

In the first case, since the vehicle has a very reduced travel speed and an extremely rigid structure, it is highly affected by any irregularities in the road; this is exacerbated by the considerable height of the driver's cab from the ground, making the journey very uncomfortable and tiring for the driver, as well as costly in terms of time.

In the second case, the user must bear the transport costs which are currently quite substantial given the considerable weight and dimensions of the vehicle.

These costs and disadvantages have a relative higher incidence for companies that hire telehandlers in order to use them for a specific project.

In this context, the technical task underpinning the present invention is to provide a mobile lifting system, which includes a remote controlled telehandler, which obviates the drawbacks of the prior art.

The stated technical task is achieved by the system realised in accordance with claim 1.

Figure 1:
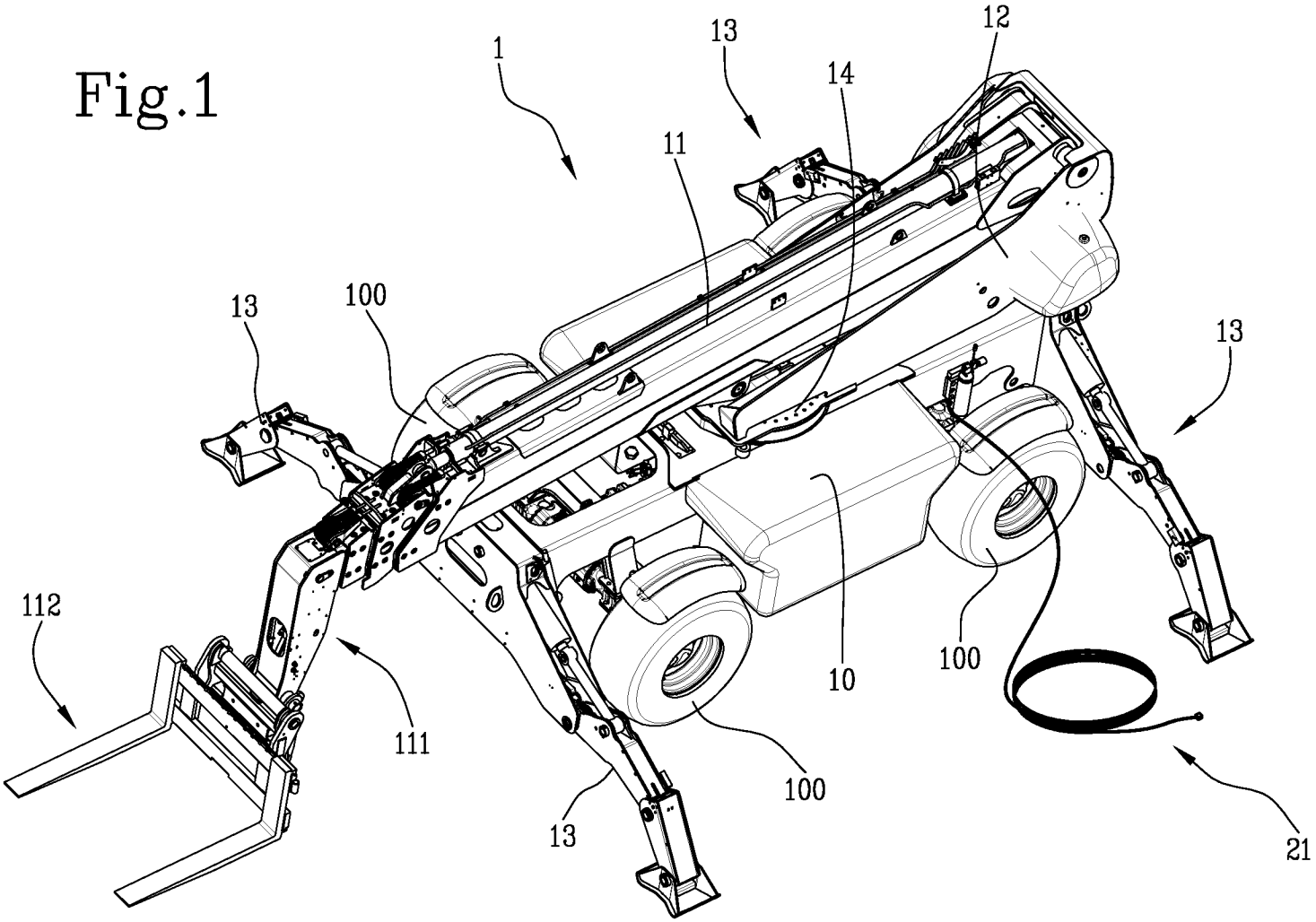
Figure 2:
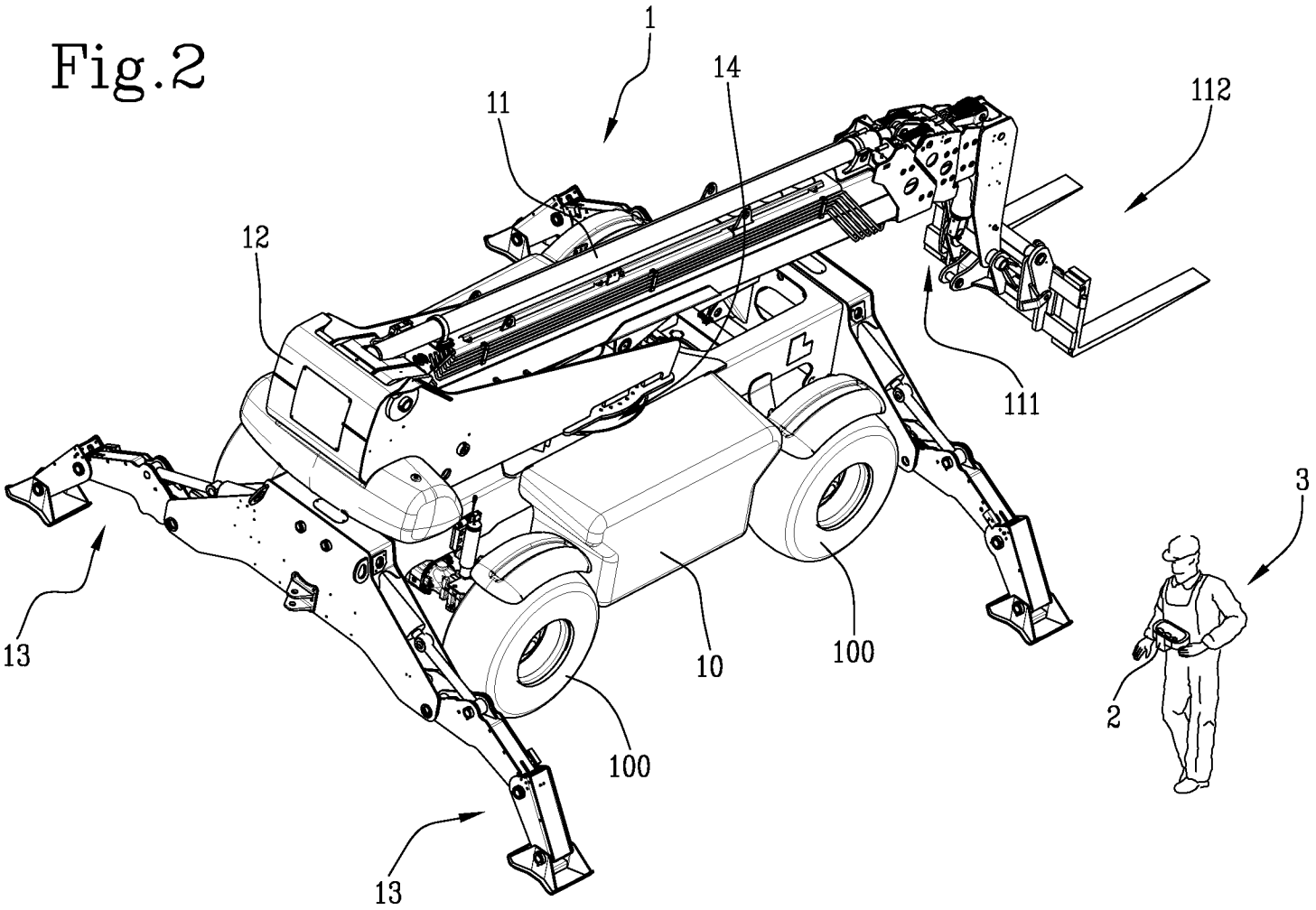

Further characteristics and advantages of the present invention will become more apparent from the approximate and thus non-limiting description of a preferred, but not exclusive, embodiment of a lifting system, as illustrated in the accompanying drawings, in which:

FIG. 1 is an axonometric view of a telehandler of the invention, according to a first embodiment; and FIG. 2 is an axonometric view of the telehandler, with a stylised operator standing next to it.

With reference to the appended drawings, the reference number 1 indicates a telehandler 1 (or "telescopic handler" or telescopic lifter) according to the invention.

The proposed telehandler 1 has a frame 10 which moves on wheels 100, on which a telescopic lifting arm 11 is mounted which has at its distal end a coupling device 111 for the removable fixing of equipment adapted to grip loads 112, such as a fork, a gripper or the like, or a basket for lifting persons and work tools.

It should be noted that this invention is a telehandler in the strict sense, namely a multi-purpose telescopic lifter which can lift loads or people and can carry many different types of equipment, thanks to the coupling device 111 cited above.

The proposed telehandler 1 is therefore not comparable, for example, to an aerial platform, which has an integral and non-replaceable load basket.

The telehandler 1 of the invention can for example be of the rotary type, such as that depicted in the accompanying figures, and thus be provided with a turret 12, which is hinged to the arm 11, to rotate around a horizontal axis, said turret 12 is mounted on the base frame 10 and is able to rotate around a vertical axis; alternatively, the telehandler 1 can be of the fixed type, namely having the arm 11 hinged directly to the base frame 10 at its proximal end, so as to rotate around a horizontal axis.

It should be noted in the present description that when the terms "horizontal" or "vertical" are used, reference is made to the case in which the telehandler 1 is resting on a flat horizontal plane.

Furthermore, in place of the wheels 100, the machine 1 can be provided with other means of engagement with the ground, such as tracks or otherwise.

Advantageously, the proposed machine 1 is fully remote controlled and is free from a cab and commands arranged therein which are manually activated in the known vehicles, comprising drive commands of the vehicle 1, commands for movement of the arm 11 and for activating the stabilisers 13 (to be discussed below).

Since the machine of the invention is free from a cab and from any manually activatable commands, the arm 11 can be mounted centrally with respect to the frame 10, although this is not a mandatory measure.

More precisely, if the telehandler 1 is rotary, the fifth wheel 14 that rotationally connects the turret 12 to the frame 10 can be positioned with its axis perpendicular to the central axes of the turret 12 and the frame 10, i.e. centrally with respect to the lateral dimensions of both the frame 10 and the turret 12.

In other words, the turret 12 and the arm 11 can be mounted in such a way that, when oriented parallel to the frame 10, they are placed in line with its central longitudinal axis; in this position, the arm 11 is superimposed on the turret 12 and this is superimposed on the frame 10.

In such an arrangement, the longitudinal central axes of the frame 10, the turret 12 and the arm 11 are placed on the same vertical plane.

If the machine 1 is of the fixed type, the hinge of the arm 11 can be mounted centrally to the frame 10, with respect to its width, so that the arm 11 itself is superimposed on the frame 10 with the respective longitudinal central axes placed on the same vertical plane.

The machine 1 of the invention comprises a powertrain assembly for its movement, which in turn comprises a motor and transmission.

According to an important aspect of the invention, control means are provided, arranged on board the telehandler 1 and adapted to manage the operation of the powertrain assembly.

The control means, which can include an electronic control unit (also of the type normally present on telehandlers 1) or other electronic processing unit, are adapted to receive command signals and are adapted to regulate the operation of the powertrain assembly according to the command signals received.

The control unit, or processing unit, included in the control means of the invention can be constituted by a single electronic device, suitably programmed to perform the described functionality, or such functionalities can be performed by a plurality of electronic devices on which the aforesaid functional modules can be distributed.

The processing unit can rely on one or more microprocessors or microcontrollers to execute the instructions contained in the memory modules.

In detail, the powertrain assembly is configured to be controlled by signals produced by the control means, both as concerns the operation of the motor, which can be an internal combustion motor or a hybrid motor or even completely electric, and as concerns both steering and braking.

Preferably, the powertrain assembly includes a plurality of electro-hydraulic or electromechanical actuators and both these and the motor are actuated by electrical control signals produced by the control means, in accordance with the command signals received.

In particular, the steering apparatus comprises one or more electro-hydraulic or electromechanical actuators activated by steering signals received by the control means; similarly, the braking apparatus comprises one or more electro-hydraulic or electromechanical actuators activated by the braking signals received by the control means.

Next to the machine 1, the invention envisages the use of command means 2, separate from the telehandler 1, to be activated by an operator 3 and arranged to produce the command signals.

The association between the command means 2, which can for example be constituted by a portable remote control 2 and the telehandler 1 described above, define a movable lifting system 1, 2 which, as will be better understood below, overcomes all of the of the limitations of the prior art.

The command means 2 are provided with commands which can be activated or selected by the user, to determine the command signals produced and transmitted to the machine 1.

In the case wherein the command means 2 comprise a remote control 2, the commands can be constituted by levers, buttons, indices shown on a touchscreen, or other commands of known type, activatable by an operator 3; furthermore, the command means 2 can be provided with various kinds of haptic interface systems.

The remote control can be a radio command 2 (see FIG. 2), and in this case the control means comprise a radio frequency transceiving system, or the use of a signal transmission element 21 (see FIG. 1) can be envisaged, adapted to connect the remote control 2 and the control means, such as a cable 21 for electrical signals or fibre optics, etc. . . . .

In general, the control means and the command means 2 are arranged for exchanging signals remotely; in this way, the operator 3, who clearly does not climb aboard the machine 1, as it is not equipped with a cab, can control the telehandler 1 remotely, determining both its operating speed, translation direction and braking.

The operation of the invention will be further explained after having described some advantageous optional aspects of the system 1, 2.

The lifting arm 11 of the proposed machine 1, as in the known machines 1, is activated by at least one hydraulic lifting and lowering cylinder and at least one hydraulic elongation and retraction cylinder, which are controlled by an electro-hydraulic distributor placed on board the telehandler 1, although the possibility of using a different type of means for producing the movement of the arm 11 is not excluded.

The invention envisages that the operation of the arm 11 is subject to the control means and that the command means 2 are arranged to produce manoeuvring signals adapted to regulate the movement of the arm 11.

In detail, the distributor receives control signals from the control means that regulate the movement of the arm 11 in accordance with the commands selected by the operator 3.

Therefore, in a preferred embodiment, with the same remote control 2 the operator 3 can control both the translation of the telehandler 1 and the movement of the arm 11.

More precisely, in the case of a rotary telehandler 1, the remote control 2 is also used to regulate the rotation of the turret 12; in this case, the actuator which acts on the fifth wheel 14 of the turret 12 receives control signals from the control means cited several times above and consequently determines the rotation of the turret 12 itself, in accordance with the selections made by the operator 3 on the remote control 2.

Furthermore, the remote control 2 and control means can also be configured to command the operation of the equipment, if present, such as lateral translation or rotation movements, etc. . . . .

Additionally, the proposed telehandler 1 also comprises stabilisers 13 which can be like those commonly present in the known machines.

The invention advantageously also envisages that the activation of the stabilisers 13 is controlled by the operator 3 through the remote control 2.

More generally, the activation means which manage the operation of the stabilisers 13 are subject to the control means, which receive stabilisation signals from the command means 2 adapted to regulate the operation of the stabilisers 13 themselves.

Since the machine 1 of the invention is free from a cab and from all the mechanical connection systems between the commands in the cab and the motor and the transmission, it is lighter and less bulky than the known machines.

Therefore, the user can hire the proposed lifting system, inclusive of the machine 1 and the remote control 2 and transport it, by means of a lorry or the like, to the work site, with reduced costs compared to those required for the transport of the known operating machines.

Once the telehandler 1 is brought to the work site, it is unloaded from the trailer of the lorry, through the activation of the remote control 2, and is made to translate until it reaches the area where it must operate.

Once the machine 1 has been positioned in the right point and in the correct position to perform the planned manoeuvres, the operator 3 commands the descent of the stabilisers 13, always acting on the remote control 2, until the lifting of the telehandler 1.

The same remote control 2 is then used by the operator 3 to manoeuvre the lifting arm 11, for example to grip, lift and unload a load, through the equipment 112 mounted on the arm 11 itself or to perform other load lifting or lowering operations.

Note that, if the arm 11 carries a load basket instead of equipment, the operator 3 can command the translation, stabilisation or manoeuvring of the working arm 11 directly from the edge of the basket, always using the remote control 2 of the invention.

The invention claimed is:

1. A mobile lifting system (1, 2), comprising a telehandler (1), in turn comprising:

a) a telescopic lifting arm (11) extending between first and second ends, wherein a coupling device (111) is provided at the second end of the telescopic lifting arm (11) and is configured for the removable fixing of an equipment (112);

b) a base frame (10) which comprises a powertrain assembly for movement of the telehandler (1) on the ground, said powertrain assembly including a motor and a transmission, said base frame (10) extending longitudinally between first and second ends thereof; and c) a fifth wheel (14) that rotationally connects a turret (12) to the base frame (10), wherein the fifth wheel (14) is provided at a longitudinal center point of the base frame (10), wherein the turret (12) is configured to rotate around a vertical axis extending through the fifth wheel (14), and wherein the turret (12) extends between first and second ends, the first end of the turret (12)

being provided at the fifth wheel (14), and the first end of the telescopic lifting arm (11) being hingedly connected to the second end of the turret (12), wherein a longitudinal length of the turret is less than a corresponding longitudinal length of the frame, wherein the telescopic lifting arm (11) is pivotable between raised and lowered positions, and wherein when the telescopic lifting arm (11) is in the lowered position, a portion of the telescopic lifting arm (11) is superimposed on the frame (10) without being superimposed on the turret (12), wherein the telescopic lifting arm (11) is mounted on top of the base frame (10) in a configuration such that, in use when the telescopic lifting arm (11) rotates, the base frame (10), including the motor, remains stationary;

wherein the mobile lifting system (1, 2) further comprises:

control means, arranged on board the telehandler (1), provided to manage the operation of said powertrain assembly, adapted to receive command signals and adapted to regulate the operation of the telehandler (1) according to said command signals; and command means (2), separate from the telehandler (1), to be activated by an operator (3) and predisposed to produce command signals;

wherein the telehandler (1) is provided with first and second stabilisers (13) and activation means, adapted to manage the operation of the first and second stabilisers and subjected to the control means, wherein the command means (2) is provided to produce stabilisation signals adapted to regulate the operation of the first and second stabilisers (13), wherein the first and second stabilisers (13) are provided adjacent the first and second ends of the base frame (10), respectively, and wherein when the second end of the telescopic lifting arm (11) extends past the first end of the base fame (10), the second end of the turret (12) laterally extends to the second end of the base frame (10).

2. The system (1, 2) according to claim 1, wherein the telehandler (1) is free from a cab and from manually activatable drive commands.

3. The system (1, 2) according to claim 1, wherein said command means (2) and the control means are adapted to communicate remotely.

4. The system (1, 2) according to claim 3, wherein the command means comprises a portable remote control (2).

5. The system according to claim 3, wherein the command means (2) comprises a remote control (2) and an element for transmitting signals (21) adapted to connect the remote control (2) and the control means.

6. The system (1, 2) according to claim 1, wherein the telehandler (1) is provided with a means for producing the movement of said telescopic lifting arm (11) subjected to the control means, wherein the command means (2) is provided to produce movement signals adapted to regulate the movement of the telescopic lifting arm (11).

7. The system (1, 2) according to claim 1, wherein the equipment (112) is adapted to grip a load or is adapted to lift a person.

8. The system (1, 2) according to claim 7, wherein the equipment (112) is a fork, a gripper, or a basket.

9. The system (1, 2) according to claim 1, wherein the turret (12) has a longitudinal length that is less than a corresponding longitudinal length of the base frame (10).

10. The system (1, 2) according to claim 9, wherein the telescopic lifting arm (11) is telescopically extendable between extended and retracted positions, wherein a longitudinal length of the telescopic lifting arm (11) in the retracted position is greater than a corresponding longitudinal length of the turret (12).

11. The system (1, 2) according to claim 1, wherein said portion of the telescopic lifting arm (11) extends beyond the first end of the turret (12).

* * * * *